US006635605B1

(12) United States Patent
Como et al.

(10) Patent No.: US 6,635,605 B1
(45) Date of Patent: Oct. 21, 2003

(54) DIELECTRIC LUBRICANT AND SPARK PLUG BOOT INCLUDING THE SAME

(75) Inventors: David Jerome Como, Howell, MI (US); Barry Mark Ketola, Brighton, MI (US)

(73) Assignee: Dow Corning Corporation, Midland, MI (US)

( * ) Notice: Subject to any disclaimer, the term of this patent is extended or adjusted under 35 U.S.C. 154(b) by 444 days.

(21) Appl. No.: 09/097,123

(22) Filed: Jun. 12, 1998

(51) Int. Cl.[7] ..... C10M 105/76; H01R 13/44

(52) U.S. Cl. ..... 508/183; 508/215; 439/125; 439/890

(58) Field of Search ..... 508/183, 215

(56) References Cited

U.S. PATENT DOCUMENTS

| | | | | | |
|---|---|---|---|---|---|
| 2,644,802 | A | * | 7/1953 | Lontz | 508/183 |
| 3,664,956 | A | * | 5/1972 | Messina et al. | 508/183 |
| 3,671,429 | A | * | 6/1972 | Wright | 508/183 |
| 3,981,811 | A | * | 9/1976 | Zletz | 508/183 |
| 4,251,431 | A | * | 2/1981 | Carswell et al. | 508/183 |
| 4,324,671 | A | * | 4/1982 | Christian et al. | 508/183 |
| 4,338,376 | A | * | 7/1982 | Kritzler | 428/417 |
| 4,755,310 | A | * | 7/1988 | Mori et al. | 508/215 |
| 4,898,956 | A | | 2/1990 | Hilty | 556/401 |
| 5,238,746 | A | * | 8/1993 | Soga et al. | 428/420 |
| 5,307,660 | A | * | 5/1994 | Stoutenburg | 72/42 |
| 5,385,686 | A | | 1/1995 | Miller et al. | 252/54 |
| 5,549,836 | A | * | 8/1996 | Moses | 508/183 |

OTHER PUBLICATIONS

Dupont ; Krytox® Typical Properties data sheet; H–58510—Apr. 1997 & Jan. 1997.

Miller–Stephenson Chemical Co., Inc.; Krytox® product information.

Packard Electric; Engineering Specification No. ES–T–486; Test Method for Dielectric Strength of Secondary Ignition Cable and Components.

Packard Electric; Engineering Specification No. ES–T–926; Test Procedure for Measurement of Engage and Disengage Forces of Terminals, Connectors, and Components.

* cited by examiner

*Primary Examiner*—Ellen M. McAvoy
(74) *Attorney, Agent, or Firm*—Arne R. Jarnholm; James E. Bittell; Catherine U. Brown

(57) ABSTRACT

An improved dielectric lubricant is prepared from a (A) a phenyl-methyl siloxane having an average general formula $$Me_3(SiO)—(Me_2SiO)_x—(MePhSiO)_y13\ (SiO)Me_3$$

wherein each Me represents a methyl group, each Ph represents a phenyl group, x has a value from zero to about 0.25 and x+y=1; said phenyl-methyl siloxane having a viscosity at 25° C. from about 500 to about 10,000 centipoise in combination with (B) a polytetrafluoroethylene powdered solid. The dielectric lubricant of the invention has particular utility when applied to the interface between a silicone rubber spark plug boot and spark plug.

3 Claims, 1 Drawing Sheet

DIELECTRIC LUBRICANT AND SPARK PLUG BOOT INCLUDING THE SAME

BACKGROUND OF THE INVENTION

1. Field of the Invention

The present invention relates generally to an improved dielectric lubricant and more particularly to the use of the improved lubricant in a spark plug boot.

2. Description of the Prior Art

Spark plug boots and the insulation on the wires associated therewith are almost universally made with silicone rubbers. The spark plug boot has a cavity formed therein which is adapted for receiving a spark plug. Various agents have been employed at the spark plug-to-spark plug boot interface for the purposes of improving the dielectric capability of the interface and for preventing the spark plug and spark plug boot from bonding to one another.

U.S. Pat. No. 5,385,686, Miller et al., discloses a spark plug boot lubricant which includes a perfuoroalkylpolyether in combination with an extender in the form of a silicone grease, such as polydimethylsiloxane. Various fillers, such as silica, are also suggested.

Perfuoroalkylpolyether lubricants with polydimethylsiloxane extenders such as those disclosed in Miller et al. have been found to suffer from several drawbacks. Polydimethylsiloxane-containing lubricants often migrate into the silicone rubber of the spark plug boot, causing deterioration. Furthermore, the silicone-based lubricants of the prior art frequently do not tolerate the high temperature conditions to which the spark plug boot and lubricants are exposed. Lower molecular weight components of the silicone can bleed and/or evaporate, thus leaving behind only a gummy residue. In addition to the loss of dielectric properties, this can result in the spark plug boot bonding to the spark plug, making removal of the boot difficult. The bonding can be so severe that the spark plug boot undergoes mechanical failure upon removal.

Thus, there exists a need for a spark plug boot lubricant that can withstand a high temperature environment without the loss of dielectric properties, which does not cause physical deterioration of the spark plug boot and which prevents the spark plug boot from bonding to the spark plug.

SUMMARY OF THE INVENTION

The present inventors have discovered a novel spark plug boot lubricant that withstands the high temperature environment to which spark plug boots are subjected, without causing deterioration of the silicone rubber of the spark plug boot. Furthermore, the lubricant of the present invention prevents the spark plug boot from bonding to the spark plug and maintains its dielectric properties during use. The present invention is further directed to an improved spark plug boot in combination with the lubricant of the invention.

In accordance with the invention, there is provided a spark plug boot lubricant comprising:

(A) a phenyl-methyl siloxane having an average general formula $$Me_3SiO—(Me_2SiO)_x(MePhSiO)_y—SiMe_3$$

wherein each Me represents a methyl group, each Ph represents a phenyl group, x has a value from zero to about 0.25 and x+y=1;

said phenyl-methyl siloxane having a viscosity at 25° C. from about 500 to about 10,000 centipoise;

(B) a polytetrafluoroethylene powdered solid; and component (A) being present in an amount of 50 to 80 parts by weight and component (B) being present in an amount of 20 to 50 parts, by weight, per 100 parts by weight of the combined weights of (A) and (B).

Further in accordance with the invention, there is provided an improved silicone rubber spark plug boot. The spark plug boot has a spark plug cavity formed therein, the cavity being defined by cavity walls. The improvement comprises the cavity walls having the above-described phenyl-methyl siloxane lubricant applied thereto.

DETAILED DESCRIPTION OF THE INVENTION

Figure 1:
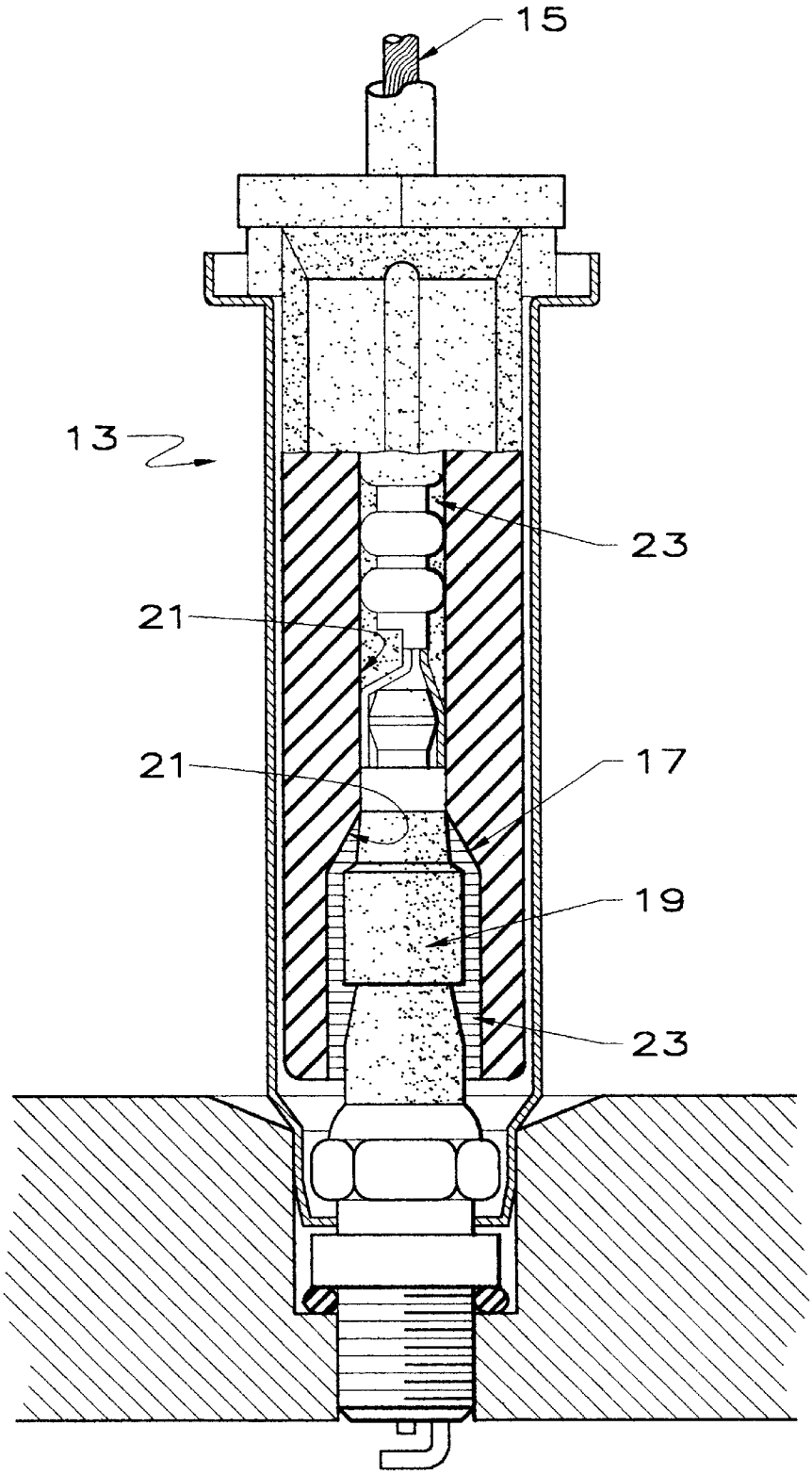
FIG. 1 is a sectional view of a spark plug boot having a spark plug boot cavity formed therein and a lubricant in accordance with the invention disposed on the walls defining the spark plug cavity.

Referring now to FIG. 1, there is illustrated a silicone rubber spark plug boot, indicated generally at 13. The spark plug boot 13 includes a spark plug wire 15 and a boot cavity 17 formed therein. The boot cavity 17 is adapted for receiving a spark plug 19. The spark plug wire 15 and spark plug 19 are in electrical communication. The boot cavity 17 is defied by cavity walls 21. The improved dielectric lubricant of the invention 23 is disposed in the boot cavity 17, between the cavity walls 21 and spark plug 19.

The spark plug boot lubricant of the invention comprises (A) a phenylmethyl siloxane and (B) a polytetrafluoroethylene powdered solid.

Component (A) has an average general formula $$Me_3SiO—(Me_2SiO)_x—(MePhSiO)_y—SiMe_3$$

wherein each Me represents a methyl group, each Ph represents a phenyl group, x has a value from zero to about 0.25 and x+y=1. The phenyl-methyl siloxane has a viscosity at 25° C. from about 500 to about 10,000 centipoise.

Phenyl-methyl siloxanes and their preparation are well-known. Those skilled in the art will appreciate that phenyl-methyl siloxanes are polydispersed. Therefore, the exact degree of polymerization cannot be specified in a general formula. Thus, in the above formula x and y represent the relative proportions of the dimethyl and phenyl-methyl units in the polysiloxane. The average degree of polymerization is directly related to viscosity, which is within a specified range.

When the viscosity of (A) is less than about 500 cps at 25° C., the phenylmethyl siloxane tends to migrate into the silicone rubber of the spark plug boot and will not provide the necessary dielectric seal. When the viscosity exceeds about 10,000 cps at 25° C., the lubricant becomes too difficult to pump into the spark plug boot cavity, which is the preferred method of application. Also, when the viscosity of (A) exceeds about 10,000 cps, the lubricant tends to pull out of the spark plug boot cavity, in a taffy-like manner, upon removal of the delivery device therefrom. Finally, the higher the viscosity of a phenyl-methyl siloxane, the more it tends to form a gum-like material upon exposure to heat. Preferably, the viscosity of (A) the phenyl-methyl siloxane does not exceed 5,000 cps and is most preferably about 1,200 cps at 25° C.

It should be noted that (A) the phenyl-methyl siloxane component may include up to about 25 mole percent dimethyl units. The inclusion of some dimethyl units in the phenyl-methyl siloxane (A) is advantageous in that the viscosity of the lubricant does not increase at low temperatures as much as when no dimethyl units are present. When the dimethyl units exceed about 25 mole percent, the lubricant again tends to migrate into the silicone rubber of the spark plug boot. Preferably, the phenyl-methyl siloxane (A) includes about 15 mole percent dimethyl units.

Component (B) is a polytetrafluoroethylene powdered solid. This component acts as a thickener of the phenyl-methyl siloxane but does not appreciably decrease the lubricity of the lubricant. The powered polytetrafluoroethylene solid preferably has a particle size of about 5 to 10 micrometers.

Components (A) and (B) are blended to substantial homogeneity, by any conventional means, in order to make the lubricant of the invention. In the improved dielectric lubricant of the invention, component (A) is present in an amount of 50 to 80 parts by weight and component (B) is present in an amount of 20 to 50 parts, by weight, per 100 parts by weight of the combined weights of (A) and (B). The final viscosity of the lubricant of the invention is preferably about 40,000 to 50,000 cps at 0° F.

The physical and dielectric properties of the improved dielectric lubricant of the invention are illustrated below, by way of example.

EXAMPLE 1

60 weight parts of a dimethyl/methylphenyl siloxane having a viscosity 1,200 cps at 25° C. and the following general formula:

$$Me_3SiO—(Me_2SiO)_{0.15}—(MePhSiO)_{0.85}—SiMe_3$$

and 40 weight parts of powdered polytetrafluoroethylene having a particle size between about 5 and 10 micrometers (available under the trade designation J-14N from Custom Compounding, a division of Dyneon LLC, Aston Pa.) were blended to homogeneity to produce a lubricant in accordance with the invention. The lubricant exhibited a fill cone penetration of about 24.0 mm at 25° C., pursuant to ASTM D217-94.

Volume swell was determined in accordance with ASTM D 471. One square inch by 0.075 inch thick, high consistency dimethylsilicone rubber specimens (available as Silastic® 23004-V DGR silicone rubber from Dow Corning Corporation, Midland, Mich.) were prepared and immersed in the lubricant for one week at 200° C. Volume swell was found to be 2.0%.

Bleed and evaporation percents were determined in accordance with Federal Standard 791, Method 321.2. The sample was tested at 200° C. for 24 hours and had bleed and evaporation rates of 2.1 and 0.7, respectively.

Dielectric strength of the spark plug boot spark plug lubricant was determined in accordance with ES-T-486 test method from Delphi-Packard Electric Systems of Warren Ohio. This test is modeled after ASTM D 149 and measures the voltage required for dielectric breakdown of a spark plug boot. In this instance, the lubricant of the invention was applied to the cavity walls of the boot. The breakdown voltage was found to be 28 Kv.

The force required to disengage a spark plug boot having a lubricated cavity from a spark plug was measured in accordance with ES-T-926 test method from Delphi-Packard Electric Systems. In this test method, a spark plug boot is engaged with an anchored spark plug having a lubricant disposed in the boot cavity and the force required to disengage the boot from the plug is measured. The disengagement force was measured after the boot and plug had been subjected to heating at 204° C. for one week and compared to the disengagement force measured on unheated specimens. The unheated specimen had a disengagement force of 15.2 lbf. The heated specimen had a disengagement force of 23.1 lbf.

EXAMPLE 2

60 weight parts of a methyl-phenyl siloxane having a viscosity 500 cps at 25° C. and the following general formula:

$$Me_3SiO—(MePhSiO)_{1.00}—SiMe_3$$

and 40 weight parts of powdered polytetrafluoroethylene having a particle size between about 5 and 10 micrometers (available under the trade designation J-14N from Custom Compounding, a division of Dyneon LLC, Aston Pa.) were blended to homogeneity to produce a lubricant in accordance with the invention. The lubricant exhibited a full cone penetration at 25° C. pursuant to ASTM D217-94 of about 26.2 mm.

Volume swell was determined as above and found to be 6.7%.

Bleed and evaporation percents were determined as above and found to be 5.1 and 0.3, respectively.

Dielectric strength of the spark plug boot spark plug lubricant was determined as above and the breakdown voltage was found to be 34 Kv.

The force required to disengage a spark plug boot having a lubricated cavity from a spark plug was measured as above. The unheated specimen had a disengagement force of 10.5 lbf. The heated specimen had a disengagement force of 14.3 lbf.

COMPARATIVE EXAMPLE 1

84 weight parts of a trimethylsilyl-endblocked polydimethylsiloxane having a viscosity 30,000 cps at 25° C. and 7 weight parts of powdered polytetrafluoroethylene having a particle size between about 5 and 10 micrometers (available under the trade designation J-14N from Custom Compounding, a division of Dyneon LLC, Aston Pa.) and 9 weight parts fumed silica were blended to homogeneity to produce a lubricant. The lubricant exhibited a full cone penetration at 25° C. pursuant to ASTM D217-94 of about 28.0 mm.

Volume swell was determined as above and found to be 9.4%.

Bleed and evaporation percents were determined as above and found to be 0.1 and 1.3, respectively.

Dielectric strength of the spark plug boot spark plug lubricant was determined as above and the breakdown voltage was found to be 27 Kv.

The force required to disengage a spark plug boot having a lubricated cavity from a spark plug was measured as above. The unheated specimen had a disengagement force of 18.5 lbf. The heated specimen had a disengagement force of 50.3 lbf.

COMPARATIVE EXAMPLE 2

A sample of Krytox® GPL205 High Performance Fluorinated Lubricant from Miller-Stephenson Chemical Co., Inc., of Morton Grove Ill., was obtained. This material is advertised as being about 70 weight parts perfuoroalkylpolyether and 30 weight parts of a tetrafluorpolyethylene filler. The Krytox® GPL205 exhibited a full cone penetration at 25° C. pursuant to ASTM D217-94 of about 27.8 mm.

Volume swell was determined as above and found to be 0.0%.

Bleed and evaporation percents were determined as above and found to be 7.0 and 0.5, respectively.

Dielectric strength of the spark plug boot spark plug lubricant was determined as above and the breakdown voltage was found to be 27 Kv.

The force required to disengage a spark plug boot having a lubricated cavity from a spark plug was measured as above. The unheated specimen had a disengagement force of 10.5 lbf. The heated specimen had a disengagement force of 26.7 lbf.

Although the improved dielectric lubricant of the invention and the improved spark plug boot which has the lubricant of the invention disposed on the cavity walls thereof have been illustrated by way of example in order to show various features and advantages thereof, the scope of the present invention is not so-limited and should be construed only in accordance with the following claims and equivalents thereof.

What is claimed is:

1. In a silicone rubber spark plug boot having a boot cavity formed therein, said boot cavity being defined by cavity walls, said boot cavity having a dielectric lubricant disposed therein, the improvement comprising said dielectric lubricant comprising:

(A) a phenyl-methyl siloxane having an average general formula $Me_3SiO—(Me_2SiO)_x—(MePhSiO)_y—SiMe_3$, wherein each Me represents a methyl group, each Ph represents a phenyl group, x has a value from 0 to about 0.25 and x+y=1;

said phenyl-methyl siloxane having a viscosity at 25° C. from about 500 to about 10,000 centipoise;

(B) a polytetrafluoroethylene powdered solid; and component (A) being present in an amount of 50 to 80 parts by weight and component (B) being present in an amount of 20 to 50 parts, by weight, per 100 parts by weight of the combined weights of (A) and (B).

2. A method for lubricating a spark plug boot comprising walls defining a spark plug cavity, wherein the method comprises disposing a lubricant on the walls defining the spark plug cavity, wherein the lubricant comprises:

(A) 50 to 80 parts by weight of a phenyl-methyl siloxane having an average general formula $(CH_3)_3SiO—((CH_3)_2SiO)_x—(CH_3(C_6H_5)SiO)_y—Si(CH_3)_3$, wherein x has a value from 0 to about 0.25, x+y=1, and the phenyl-methyl siloxane has a viscosity at 25° C. from about 500 to about 10,000; and (B) 20 to 50 parts by weight of a polytetrafluoroethylene powdered solid.

3. The method of claim 2, wherein the lubricant is disposed on the walls defining the spark plug cavity by pumping.

* * * * *